United States Patent [19]

Herrmann

[11] Patent Number: 4,806,118

[45] Date of Patent: Feb. 21, 1989

[54] FUSE PACKAGE

[75] Inventor: Alan J. Herrmann, Southington, Ohio

[73] Assignee: General Motors Corporation, Detroit, Mich.

[21] Appl. No.: 144,940

[22] Filed: Jan. 19, 1988

[51] Int. Cl.[4] ..... H01R 13/68; H01R 13/627

[52] U.S. Cl. ..... 439/352; 439/621; 361/430

[58] Field of Search ..... 439/345, 350, 352, 620, 439/621, 622; 361/430, 431, 432

[56] References Cited

U.S. PATENT DOCUMENTS 4,687,270 8/1987 Plyler et al. ..... 361/430 X

*Primary Examiner*—Eugene R. LaRoche
*Assistant Examiner*—Robert J. Pascal
*Attorney, Agent, or Firm*—F. J. Fodale

[57] ABSTRACT

A fuse package for a row of plug-in type fuses comprises a cover, a fuse retainer and an insulator block. The fuses are initially held within the cover by the fuse retainer which maintains the cover and fuses as a unitary assembly that is separately handled and installed on the insulator block. When installed the fuse retainer locks onto the insulator block and is released from the cover so that the fuses stay with the insulator block when the cover is removed.

2 Claims, 2 Drawing Sheets

FUSE PACKAGE

This invention relates generally to fuse assemblies and more specifically to fuse packages for retaining and handling a row of plug-in type fuses.

BACKGROUND OF THE INVENTION

An automotive fuse finding increasing use is a plug-in fuse of the type described in the U.S. Pat. No. 3,909,767. Such a fuse has a plastic body which includes an internal fusible link and a pair of parallel spaced blade contacts that extend out of the body. As befits the name, such a fuse is joined to the electrical system by plugging its blade contacts into suitable terminals that are otherwise connected to the vehicle's electrical system.

U.S. Pat. No. 4,687,270 which is assigned to the assignee of this patent application provides a convenient package for a row of such plug-in fuses, giving simplified handling and installation as well as replacement and servicing of the fuses. This package includes an insulator block with a pair of parallel rows of terminals that are adapted to receive the blade contacts of the row of fuses as they are plugged in. The terminals hold the fuse contacts with a gripping force sufficient to keep the fuses in place until they are purposely pulled out. The insulator block has two pairs of spaced ramps which are located between the rows of terminals.

The package further includes a cover adapted to be installed on and removed from the insulator block. The cover is adapted to hold a row of fuses with a holding force sufficient to maintain the fuses in the proper orientation to plug into the terminals as the cover is installed. The holding force, however, is less than the terminal gripping force so that the fuses are pulled out of the cover and remain plugged into the terminals when the cover is removed. The cover is generally in the form of an open box with a pair of spaced end walls which have shallow grooves.

The package also includes a fuse retainer which has flexible legs at its ends which resiliently snap into the shallow grooves in the spaced end walls of the cover to provide a retention force that is sufficient to prevent the fuse retainer and fuses from falling out of the cover before installation. The fuses, retainer and the cover may, therefore, be handled and installed together as a unitary assembly. This provides a very convenient means of handling and shipping the fuses. It also provides a convenient means for plugging the fuses into the insulator block terminals all at once, since the fuses are already properly oriented and held within the cover. The retainer also has a second pair of flexible legs that extend out from the retainer and that are located inboard of the flexible legs at the ends of the retainer.

As the unitary assembly of cover, retainer, and fuses is installed on the insulator block, the second pair of flexible retainer legs concurrently flex past and interengage with the two pairs of spaced ramps of the insulator block to lock the retainer to the insulator block. The locking force provided by the engagement of the second pair of flexible legs with the spaced ramps is greater than the retention force provided by the engagement of the flexible legs at the ends of the retainer in the shallow grooves of the cover. Therefore, the retainer stays with the insulator block when the cover is removed, and the fuses conveniently remain with the insulator block for easy individual access and removal. The cover may then be reinstalled, and will be retained to the block as before.

SUMMARY OF THE INVENTION

Generally, the object of this invention to provide an improved fuse package that easily handles and retains a plug-in fuse by holding the fuse within a cover in the proper orientation to plug into terminals of an insulator block and then releasing the fuse from the cover as the cover is installed on the block so that the fuse remains plugged into the terminals when the cover is removed from the insulator block for easy access to the fuse.

It is another object of the invention to provide an improved fuse package of the type described for a plug-in fuse in which a fuse retainer is retained within the cover to prevent the fuse from falling out of the cover before installation, so that the fuse, retainer and cover may be handled and installed together as a unitary assembly, and in which the retainer is locked to the insulator block and released from the cover when the unitary assembly is installed on the insulator block so that the cover is easily removed while the retainer and fuses stay with the insulator block.

It is yet another object of the invention to provide such an improved fuse package for retaining and handling a row of plug-in fuses of the type described in which the insulator block has a release member and in which the retainer has a pair of flexible legs which engage the cover to form the unitary cover assembly and which are disengaged by the release member so that the retainer is released from the cover when the unitary cover assembly is installed.

DESCRIPTION OF THE PREFERRED EMBODIMENT

These and other objects and features of the invention will appear from the following written description and the drawings, in which.

Figure 1:
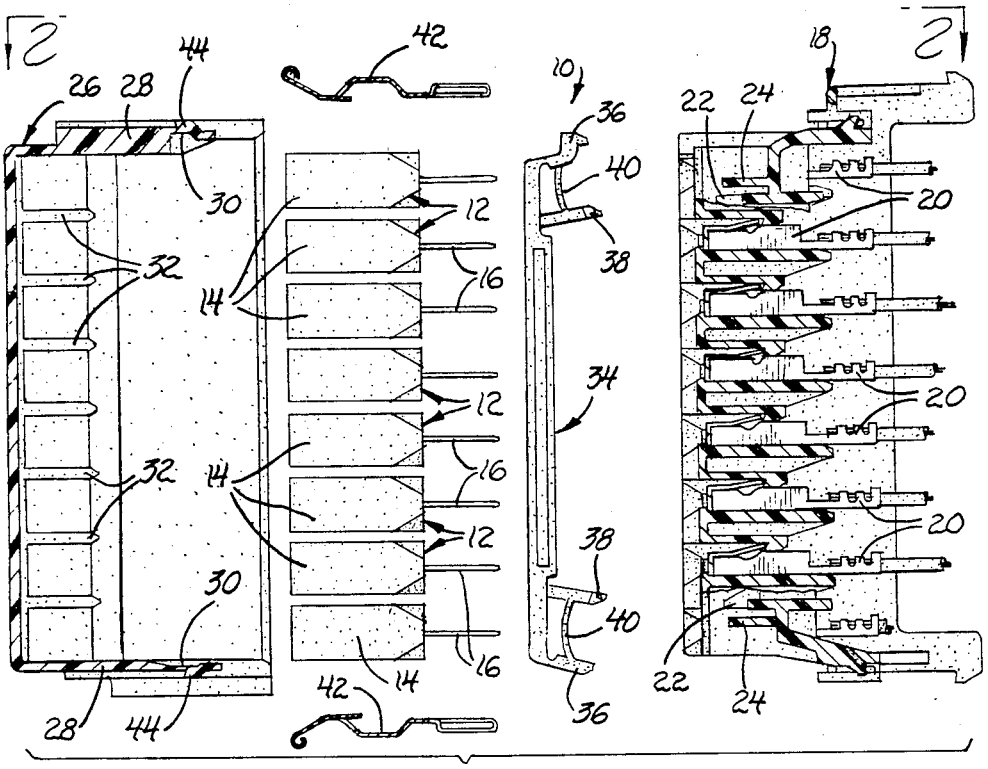
FIG. 1 is an exploded plan view of the preferred embodiment of the invention, showing the cover and insulator block in cross section.
Figure 2:
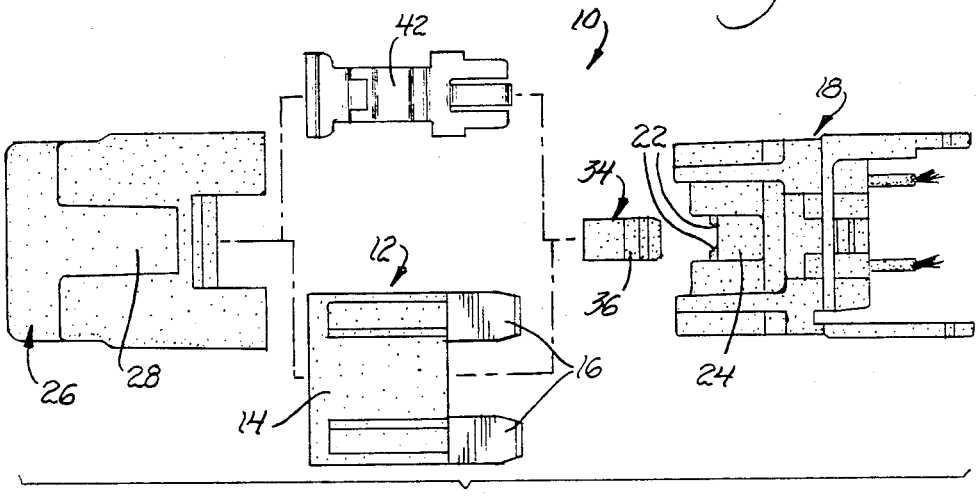
FIG. 2 is an exploded side view of the preferred embodiment.

Referring first to FIGS. 1 and 2, the preferred embodiment of the invention is designated generally at 10. The invention provides a convenient package that easily handles and retains a fuse of the plug-in type designated generally at 12, specifically a row of seven such fuses 12. Each fuse 12 includes a plastic body 14 within which a fusible link is contained and a pair of parallel blade contacts 16 extending therefrom. Therefore, the row of seven fuses 12 present two parallel rows of blade contacts 16. An advantage of a fuse 12 of the plug-in type is that its relatively large plastic body 14 provides a convenient grip for insertion and removal of the fuse into and out of the vehicle's electrical system. The invention 10 advantageously handles the entire row of fuses 12, as well as providing for easy replacement and servicing of the individual fuses 12, as will appear below.

Figure 3:
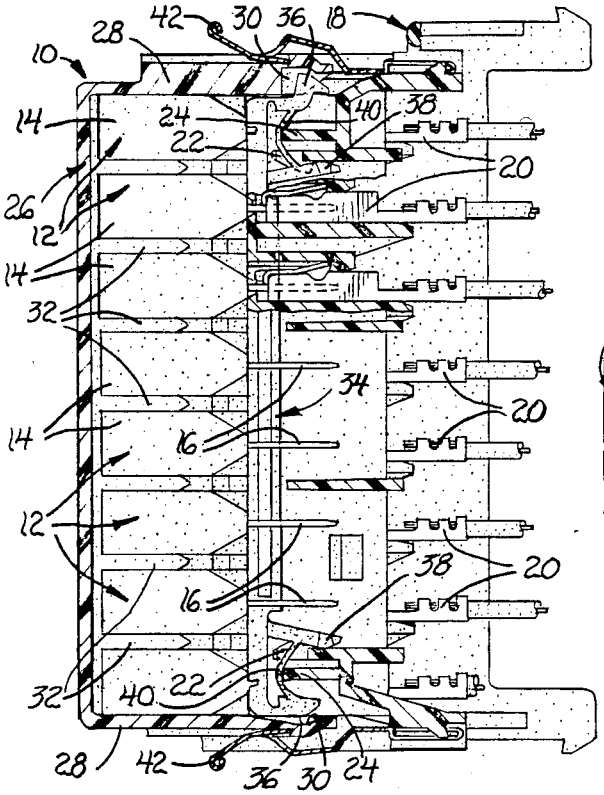
FIG. 3 is a view similar to FIG. 1, but with all the parts assembled.
Figure 5:
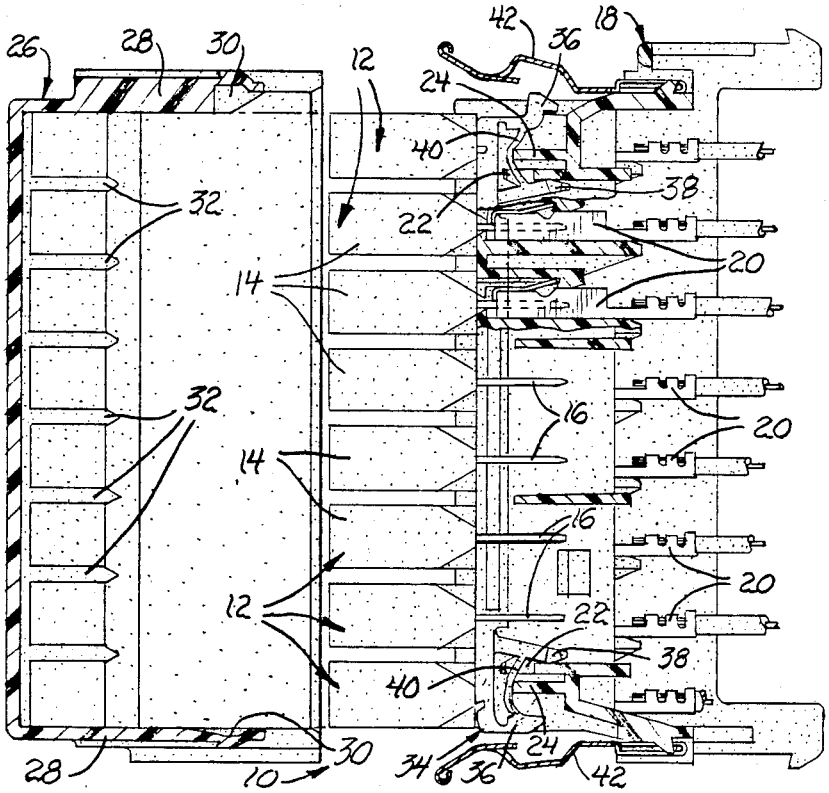
FIG. 5 is a view similar to FIG. 3, but with the cover removed.

Referring now to FIGS. 1, 3 and 5, a plastic insulator block generally in the shape of a box is designated at 18.

Insulator block 18 includes a pair of parallel rows of terminals 20 arrayed where within, one pair of terminals 20 respective to each fuse 12. The terminals 20 are otherwise connected to the vehicle electrical system, not illustrated, in conventional fashion. The terminals 20 are designed to be sufficiently resilient to grip and hold the blade contacts 16 of the row of fuses 12 as they are plugged in, as best seen in FIGS. 3 and 5. The gripping force of the terminals 20 on the fuse contacts 16 is sufficient to keep the fuses 12 in place on the block 18, as seen in FIG. 5, until they are purposely pulled out.

The insulator block 18 also includes two pairs of integrally molded lock ramps designated generally at 22, which are located near the respective ends of the insulator block 18 between the rows of terminals 20. Each pair of lock ramps 22 are spaced apart to cooperate with the retainer as explained below. The insulator block 18 also has a release member 24 outboard of each pair of lock ramps 22.

The invention 10 also includes a plastic cover, designated generally at 26, molded in the form of an open box with a pair of spaced end walls 28. The inside of each end wall 28 has a shallow, sloped groove 30 for a purpose described below. Cover 26 is sized so as to fit over insulator block 18, and can therefore be installed on and removed therefrom with a simple push fit. The installed position is shown in FIG. 3, and the removed position in FIG. 5. The bottom of cover 26 is provided with a row of seven internal dividers 32 which hold the row of seven fuses 12 in the proper orientation to plug into the terminals 20 all at once as the cover 26 is installed. The holding force of the dividers 32 is very slight, and the fuses 12 may be very easily dropped into the cover 26 with no binding. This is desirable for ease of assembly, but it also means that the fuses 12 would fall out of the cover 26 without additional structure, and the advantage of having the fuses 12 oriented so as to plug into the terminals 20 all at once as the cover 26 is installed would be largely illusory.

Consequently the fuses 12 are held in the cover 26 by a fuse retainer 34 which is narrow and elongated and molded of resilient plastic. In the preferred embodiment, the ends of the retainer 34 have flexible legs 36 which resiliently snap into the shallow grooves 30 of the cover end walls 28. The retainer 34 is added after the fuses 12 have been dropped into the cover 26, and it fits between the blade contacts 16 of the row of fuses 12, beneath the fuse bodies 14. The flexible legs 36 of the retainer 34 are biased into the shallow grooves 30 of the cover end walls 28 with a retention force that is sufficient to prevent the fuses 12 from falling out of the cover 26, even if it is turned upside down and shaken moderately, as can be expected during normal shipping and handling. The fuses 12, retainer 34 and cover 26, therefore, make up an easily handled unitary assembly. Furthermore, the retainer 34, located as it is between the rows of fuse blade contacts 16, will not interfere with the plugging in of the fuses 12. Therefore, the unitary assembly may be installed as would just the cover 26 and fuses 12 together, with the fuses 12 all plugging in to the terminals 20 at once, as seen in FIGS. 3 and 5.

Figure 4:
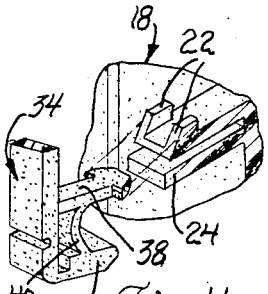
FIG. 4 is an isometric view of one end of the retainer and that portion of the insulator block it engages.

Referring now to FIG. 4, the retainer 34 also includes a second pair of generally T-shaped flexible legs 38 that extend out from the retainer 34 at locations spaced inboard of the flexible legs 36. These T-shaped flexible legs 38 cooperate with the pairs of locking ramps 22, to lock the retainer 34 to the insulator block 18. It will be recalled that the locking ramps 22 are located between the terminals 20, and that the retainer 34 is located between the fuse contacts 16, which plug into the terminals 20. It will be understood, therefore, that as the unitary cover assembly 36 is installed on the block 18, the flexible legs 38, spaced apart and located as they are, will concurrently slide over the insulator block locking ramps 22 and flex toward one another. Each of the flexible legs 38 is connected to the adjacent flexible leg 36 at the end of the retainer 34 by a strap 40. These straps 40 are engaged by the release members 24 of the insulator block 18 so that the flexible legs 36 at the ends of the retainer 34 are pulled out of the cover grooves 30 by the flexing of the T-shaped legs 38 as they slide over the locking ramps 22. As the T-shaped legs 38 slide beyond the pairs of spaced ramps 22, they snap down into the slots giving a strong interengagement at the installed position shown in FIGS. 3 and 5. This interengagement is enhanced by the release members 24 pushing on the straps 40 to provide a locking force which locks the retainer 34 to the block 18 securely. Since the retainer 34 is released from the cover 26 when it is installed, latch means are provided to latch the installed cover 26 to the insulator block 18. This latch means takes the form of sheet metal spring clips 42 which are mounted on the external side of the end walls 28 of the insulator block 18. The spring clips 42 engage lock nibs 44 of the cover 26 to retain the cover 26.

Referring now to FIG. 5, the spring clips 42 are spread apart to release the cover 26 which is then freely removable because the flexible legs 36 of the fuse retainer 34 are disengaged from the grooves 30 inside the cover 26. As the cover 26 is removed, the retainer 34 stays with the insulator block 18 and the fuses 12 remain plugged into the terminals 20, easily accessible and visible for individual removal and replacement. The ends of the spring clips 42 carried by the insulator block 18 will snap back into engagement with the lock nibs 44 to again latch the cover 26 to the insulator block 18 when the cover 26 is reinstalled.

I wish it to be understood that I do not desire to be limited to the exact details of construction shown and described, for obvious modifications will occur to a person skilled in the art.

The embodiments of the invention in which an exclusive property or privilege is claimed are defined as follows:

1. A fuse package for retaining and handling a plug-in type fuse, said package comprising, an insulator block including a lock ramp and a release member and an electrical terminal adapted to receive the plug-in fuse with a gripping force, a cover adapted to be installed and removed from the insulator block and also adapted to hold a plug-in type fuse with a holding force sufficient to maintain said fuse in the proper orientation to plug into said terminal as said cover is installed, but less than said gripping force so that said fuse remains with said terminal and block as said cover is removed, a fuse retainer having a flexible leg at each end which engages the cover with a retention force sufficient to prevent said fuse from falling out of said cover before installation, so that said fuse, retainer and cover may be handled and installed together as a unitary assembly, and a second flexible leg on said retainer interengageable with the lock ramp on said insulator block as said unitary assembly is installed with a locking force sufficient to lock said retainer to said insulator block, said second flexible leg being connected to one of the flexible legs at the ends of the retainer by a strap which is engaged by the release member to release the retainer from the cover when the unitary assembly is installed whereby the retainer stays with said insulator block without interfering with the cover when the cover is removed to provide access to the fuse.

2. A fuse package for retaining and handling a row of plug-in fuse of the type having a fuse body and a pair of parallel blades, said package comprising, an insulator block including two parallel rows of electrical terminals adapted to receive said fuse blades with a gripping force and also including a pair of lock ramps and a release member located between the rows of terminals near each end of the insulator block, a cover having a pair of spaced walls and adapted to be installed on and removed from said insulator block and also adapted to hold a row of said plug-in fuses of said type with a holding force sufficient to maintain said fuses in the proper orientation to plug into said terminals as said cover is installed, but less than said gripping force so that said fuses remain with said terminals and block as said cover is removed, an elongated fuse retainer having a flexible leg at each end which engages a cooperating shallow groove in the cover with a retention force sufficient to prevent the fuses from falling out of the cover before installtion so that the fuses, retainer and cover may be handled and installed together as a unitary assembly, and a pair of flexible T-shaped legs extending out from the retainer inboard of the retainer ends and interengageable with the pairs of lock ramps with a locking force sufficient to lock the retainer to the insulator block, said flexible T-shaped legs being connected to the respectively flexible legs at the ends of the fuse retainer by straps which are engaged by the release members of the insulator block to disengage the flexible legs from the shallow grooves and thereby release the fuse retainer from the cover when the unitary assembly is installed.

* * * * *